US008876023B2

(12) United States Patent
Peel et al.

(10) Patent No.: US 8,876,023 B2
(45) Date of Patent: Nov. 4, 2014

(54) SHOWERHEAD

(75) Inventors: Kevin Taylor Peel, Gloucester (GB); Jennifer Ellen Barnard, Surrey (GB); Simon Westgate, Gloucester (GB); Alexander Fagg, Gloucester (GB); Craig Edwin Baker, Gloucester (GB); Peter Thomas Green, Worcester (GB)

(73) Assignee: Kohler Mira Limited, Gloucestershire (GB)

( * ) Notice: Subject to any disclaimer, the term of this patent is extended or adjusted under 35 U.S.C. 154(b) by 1290 days.

(21) Appl. No.: 12/672,729

(22) PCT Filed: Aug. 11, 2008

(86) PCT No.: PCT/GB2008/002703

§ 371 (c)(1), (2), (4) Date: Apr. 30, 2010

(87) PCT Pub. No.: WO2009/022112

PCT Pub. Date: Feb. 19, 2009

(65) Prior Publication Data

US 2010/0213282 A1 Aug. 26, 2010

(30) Foreign Application Priority Data

Aug. 10, 2007 (GB) ..... 0715612.8
Mar. 6, 2008 (GB) ..... 0804172.5

(51) Int. Cl.

| | |
|---|---|
| ***A62C 31/00*** | (2006.01) |
| ***E03C 1/04*** | (2006.01) |
| ***B05B 1/18*** | (2006.01) |
| ***B05B 1/16*** | (2006.01) |
| *B05B 15/06* | (2006.01) |

(52) U.S. Cl.

CPC ..... *B05B 1/1654* (2013.01); *B05B 15/066* (2013.01); *E03C 1/0408* (2013.01); *B05B 1/185* (2013.01)

USPC ..... 239/447; 239/393; 239/444; 239/446; 239/556; 239/559; 239/587.1; 239/587.5; 4/567; 4/615

(58) Field of Classification Search

CPC ..... B05B 1/14; B05B 1/18; B05B 1/185; B05B 1/262; B05B 1/1618; B05B 1/1636; B05B 1/1645; B05B 1/6663; B05B 13/0431; B05B 15/065; B05B 15/066; B05B 15/067

USPC ..... 239/390, 393, 443, 446–449, 548, 552, 239/556, 558, 559, 587.1, 587.5, 587.6; 4/605, 615, 567

See application file for complete search history.

(56) References Cited

U.S. PATENT DOCUMENTS 3,319,893 A * 5/1967 Caves et al. ..... 239/393
4,169,557 A * 10/1979 Greeott ..... 239/443
6,442,775 B1 * 9/2002 Gransow et al. ..... 4/615

(Continued)

FOREIGN PATENT DOCUMENTS

DE 20 2007 004726 U1 6/2007

OTHER PUBLICATIONS

International Search Report: PCT/GB2008/002703.

(Continued)

*Primary Examiner* — Steven J Ganey
(74) *Attorney, Agent, or Firm* — Foley & Lardner LLP

(57) ABSTRACT

A showerhead (20) has a spray head (32) having a plurality of spray outlets (36, 38,42,44) on different faces is mounted for manual rotation about a single pivot axis both to select a spray outlet and to adjust the direction of the spray for the selected spray outlet. The showerhead can be configured so that flow of water is uninterrupted during changeover between spray modes. Alternative versions of the showerhead are disclosed in which the spray head is mounted for powered rotation, for example by a motor, allowing remote operation of the showerhead.

24 Claims, 15 Drawing Sheets

(56) References Cited

U.S. PATENT DOCUMENTS 7,360,723 B2 * 4/2008 Lev ..... 239/443
7,980,489 B2 * 7/2011 Righini ..... 239/393

OTHER PUBLICATIONS

Examiner's First Report for Australian Patent Application No. 2008288340 dated Apr. 10, 2012; 2 pages.

* cited by examiner 20
1
26
32
48
24

8
32
26
24
48

2
26
32
50
24

7
32
26
24

3
32
26
24

6
32
26
24
52

4
26
32
24
46

5
26
32
24

1
194
190
196
192
198

2
204
208

3

4

5
200
202

6
210
206

7

8

SHOWERHEAD

BACKGROUND OF THE INVENTION

This invention relates to spray fittings and has particular, but not exclusive, application to spray fittings for showering. The invention is described hereinafter applied to showerheads although it will be understood that the invention has wider application and the term "showerhead" is to be construed accordingly.

A common showerhead comprises a handset having a spray head that is adjustable to allow selection of one or more of a number of different spray modes. In a typical arrangement, the handset is mounted on a support bracket that is moveable along a riser rail to adjust the height of the spray head, and the handset is pivotal relative to the support bracket to adjust the direction of the spray for a selected spray mode. With this arrangement, two separate means of adjustment are required, one to change the spray mode and another to change the direction of the spray.

In this known arrangement, the sprays for different spray modes are provided by arrays of spray nozzles in one spray plate, typically concentric annular arrays of spray nozzles. With this arrangement, each array of nozzles is restricted to a specific area of the spray plate with the result that the spray coverage can vary, when changing from one array of nozzles to another.

The present invention seeks to alleviate one or more of the problems and disadvantages of existing showerheads.

It is a preferred object of the invention to provide a showerhead in which the spray mode and the direction of the spray for a selected spray mode can be changed in one operation.

It is another preferred object of the invention to provide a showerhead in which water flow can be maintained when changing the spray mode to alter the spray.

It is yet another preferred object of the invention to provide a showerhead in which a full spray can be maintained while changing the direction of the spray for a selected spray mode.

These and other objects and advantages of the invention are generally achieved according to the invention by a showerhead having a spray head mounted for rotation about a pivot axis both to select a spray mode and to adjust the direction of the spray for the selected spray mode.

By this invention, both the spray mode and the direction of the spray for the selected spray mode can be changed by rotation of the spray head in one operation. Such a showerhead provides improved ease of use and may allow enhanced styling.

Preferably, flow of water is uninterrupted during changeover between spray modes. Uninterrupted flow of the water from the showerhead enables the showerhead to be used in applications where a continuous flow of water is required, for example where the showerhead is supplied with water from an instantaneous water heater or from a combination boiler.

In one arrangement, uninterrupted flow can be achieved by providing an overlap between adjacent spray modes so that, when changing from one spray mode to another spray mode, flow of water is provided through both spray modes. Alternatively, or additionally, uninterrupted flow can be achieved by providing the showerhead with an outlet that is connected to the water supply at least during changeover between spray modes. In this arrangement, flow of water from the spray head can be interrupted during changeover between spray modes of the spray head while maintaining flow of water from the showerhead.

Preferably, the spray head is mounted for rotation about a single pivot axis to select any one of a plurality of spray modes angularly spaced apart in the direction of rotation. Preferably, each spray mode has associated spray discharge means, and the spray head can be rotated for discharging water through the spray discharge means of a selected spray mode and for adjusting the direction of the spray for the selected spray mode. Preferably, the direction of the spray from the spray discharge means in each mode is transverse to the pivot axis of the spray head.

In at least one preferred embodiment, the spray head has two spray modes. The spray discharge means of the two spray modes may be arranged on opposite sides of the spray head. In this arrangement, the spray head may be rotatable through 180° to select either one of the two spray modes. Alternatively, the spray discharge means of one of the spray modes may be arranged on one side of the spray head and the spray discharge means of the other spray mode may be arranged on a side edge of the spray head. In this arrangement the spray head may be rotatable through less than 180° to select either one of the two spray modes, for example 90°.

In at least one preferred embodiment, the spray head has three spray modes. The spray discharge means of two of the spray modes may be arranged on opposite sides of the spray head and the spray discharge means of the third spray mode may be arranged on a side edge of the spray head. Alternatively, the spray discharge means of two of the spray modes may be arranged on opposite side edges of the spray head and the spray discharge means of the third spray mode may be arranged on one side of the spray head. In both arrangements, the spray head may be rotatable through 180° to select either one of first and second spray modes and through less than 180°, for example 90°, from either the first or second spray modes to select the third spray mode.

In at least one preferred embodiment, the spray head has four spray modes. The spray discharge means of two of the spray modes may be arranged on opposite sides of the spray head and the spray discharge means of the other two spray modes may be arranged on opposite side edges of the spray head. In this arrangement, the spray head may be rotatable through 90° between adjacent spray modes.

By reducing the angular spacing between adjacent spray modes in the direction of rotation of the spray head, changeover from one spray mode to the next spray mode can be effected without interrupting the water flow and the spray can be confined within a desired spray area. In this way, the spray head is prevented from spraying in all directions in an uncontrolled manner during the changeover between the spray modes. Preferably, the angular spacing between adjacent spray modes without interrupting the flow is in the range 60° to 120°, more preferably 75° to 105° with approximately 90° most preferred. If the angular spacing is lower than 60°, rotation of the spray head to change the direction of the spray for the selected spray mode may be restricted. On the other hand, if the angular spacing is higher than 120°, rotation of the spray head to changeover between spray modes may cause spraying outside a desired spray area.

Preferably, the spray head includes a spray selection module responsive to rotation of the spray head for directing water flow to the spray discharge means of the selected spray mode. The spray selection module preferably allows each spray discharge means to be supplied in sequence by rotation of the spray head around the pivot axis.

In at least one preferred embodiment, the spray head includes at least one mode with spray discharge means comprising a plurality of holes in a spray plate. In at least one preferred embodiment, the spray head includes at least with mode with spray discharge means comprising a single opening. Preferably, the spray head includes at least one mode provided by a detachable spray cartridge.

Preferably, the spray head is rotatable through 360°. The spray head may be rotatable in a clockwise direction or an anticlockwise direction. Rotation of the spray head may be manual or powered. For example, the spray head may rotated by a motor, preferably a stepper motor.

Preferably, the spray head is angularly adjustable in each spray mode through an arc including a centre position of the spray head to change the spray direction in the selected spray mode. The spray head may be angularly adjustable to either side of the centre position in each spray mode. The angular adjustment to one side of the centre position may be larger than the angular adjustment to the other side. The angular adjustment below the centre position may be larger than the angular adjustment above the centre position. Preferably, the range of angular adjustment in each spray mode is the same. The range of angular adjustment in each spray mode may be 50° to 80°.

Preferably, the water flow in the selected spray mode is for the most part unchanged by angular adjustment of the spray head within the range of angular movement. As a result, the spray is largely unaffected and a full spray is obtained throughout substantially the whole range of angular movement of the spray head in the selected spray mode.

Preferably the showerhead includes a support for the spray head. The support may extend around a marginal edge of the spray head. The support may be provided with an outlet that provides uninterrupted flow of water on changing from one spray mode to another spray mode. Flow of water may be provided through the outlet in at least one spray mode. In at least one embodiment, flow of water is provided through the outlet in all positions of the spray head. The outlet may comprise a plurality of holes spaced apart in the support around the marginal edge of the spray head. The support may be configured to confine spray from the spray head within a spray area. The support may be provided by a hollow body through which water is delivered to the spray head.

In at least one embodiment, the showerhead comprises a handset. The handset may be mounted on a bracket and may be detachable from the bracket. The bracket may be fixed to a wall or similar support surface. Alternatively the bracket may be mounted on a riser rail and slidable along the rail.

In at least one embodiment, the showerhead comprises a spray unit for mounting in an opening in a wall, ceiling or similar support surface. The unit may include a spray head rotatably mounted in a support frame that is mounted in the opening so that the spray head is substantially flush with the surrounding surface, for example a tiled surface. The spray head may be manually rotatable or may be rotatable by drive means, for example a motor, especially a stepper motor.

The spray discharge means may be of any suitable type such as one or more holes or slots or a combination thereof. Holes or slots may be arranged randomly or uniformly, for example an annular array. In a preferred arrangement, the spray discharge means of each mode is arranged symmetrically with respect to the pivot axis. In this way, water flow through the discharge means does not exert a rotational force on the spray head such as may cause the spray head to move from its set position.

According to a second aspect of the invention there is provided a showerhead having a spray head mounted for rotation about a single pivot axis both to select any one of a plurality of spray modes angularly spaced apart in the direction of rotation and to adjust the direction of the spray for the selected spray mode, wherein flow of water is uninterrupted during changeover between spray modes.

Preferably, the spray head includes at least two spray modes having spray outlets disposed substantially perpendicular to each other and to the pivot axis of the spray head. More preferably, the spray head has four spray modes with outlets of adjacent spray modes disposed substantially perpendicular to each other and to the pivot axis. In a preferred arrangement, the outlets of two of the spray modes are arranged on opposite sides of the spray head and the outlets of the other two spray modes are arranged on opposite side edges of the spray head.

According to a third aspect of the invention there is provided a showerhead having a spray head mounted for rotation about a single pivot axis both to select any one of a plurality of spray modes angularly spaced apart in the direction of rotation and to adjust the direction of the spray for the selected spray mode, wherein adjacent spray modes in the direction of rotation have outlets arranged at an angle of less than 180° to each other.

Preferably, the outlets of adjacent spray modes are arranged at an angle in the range of 45° to 135° to each other, more preferably 60° to 120° with a range of 75° to 105°, more preferably approximately 90° being especially preferred. In a preferred arrangement, the flow of water is uninterrupted during changeover between the spray modes. A particularly preferred arrangement has four spray modes.

According to a fourth aspect of the invention there is provided a showerhead having a spray head with first and second spray outlets arranged substantially normal to each other wherein the spray head is mounted for rotation about a pivot axis substantially normal to each of the first and second spray outlets, wherein the spray head is rotatable both to select either the first spray outlet or the second spray outlet and to adjust the direction of the spray for the selected spray outlet.

By this arrangement of the first and second spray outlets, changeover from one spray outlet to the other spray, outlet can be effected without interrupting the water flow and the spray can be confined within a desired spray area. In this way, the spray head is prevented from spraying in all directions during the changeover between the spray outlets.

Preferably, the direction of the spray is adjustable over a range of angular movement of the spray head and a full spray is obtained throughout substantially the whole range of angular movement. By this feature, the water flow to the selected spray outlet is for the most part unchanged by angular adjustment of the spray head with the range of angular movement and the spray from the spray outlet is largely unaffected.

According to a fifth aspect of the invention there is provided a spray head comprising a water inlet, two or more spray discharge means, and a spray selection mechanism responsive to rotation of the spray head about an axis for directing flow to a selected one of the spray discharge means, wherein the spray head is rotatable for changing the selected spray discharge means and varying the angular direction of flow from the selected spray discharge means.

The spray head may be incorporated in an ablutionary fitting such as a showerhead, for example a handset.

The invention will now be described in more detail by way of example only with reference to the accompanying drawings, wherein

BRIEF DESCRIPTION OF THE DRAWING FIGURES

DETAILED DESCRIPTION OF SEVERAL EMBODIMENTS

Figure 1:
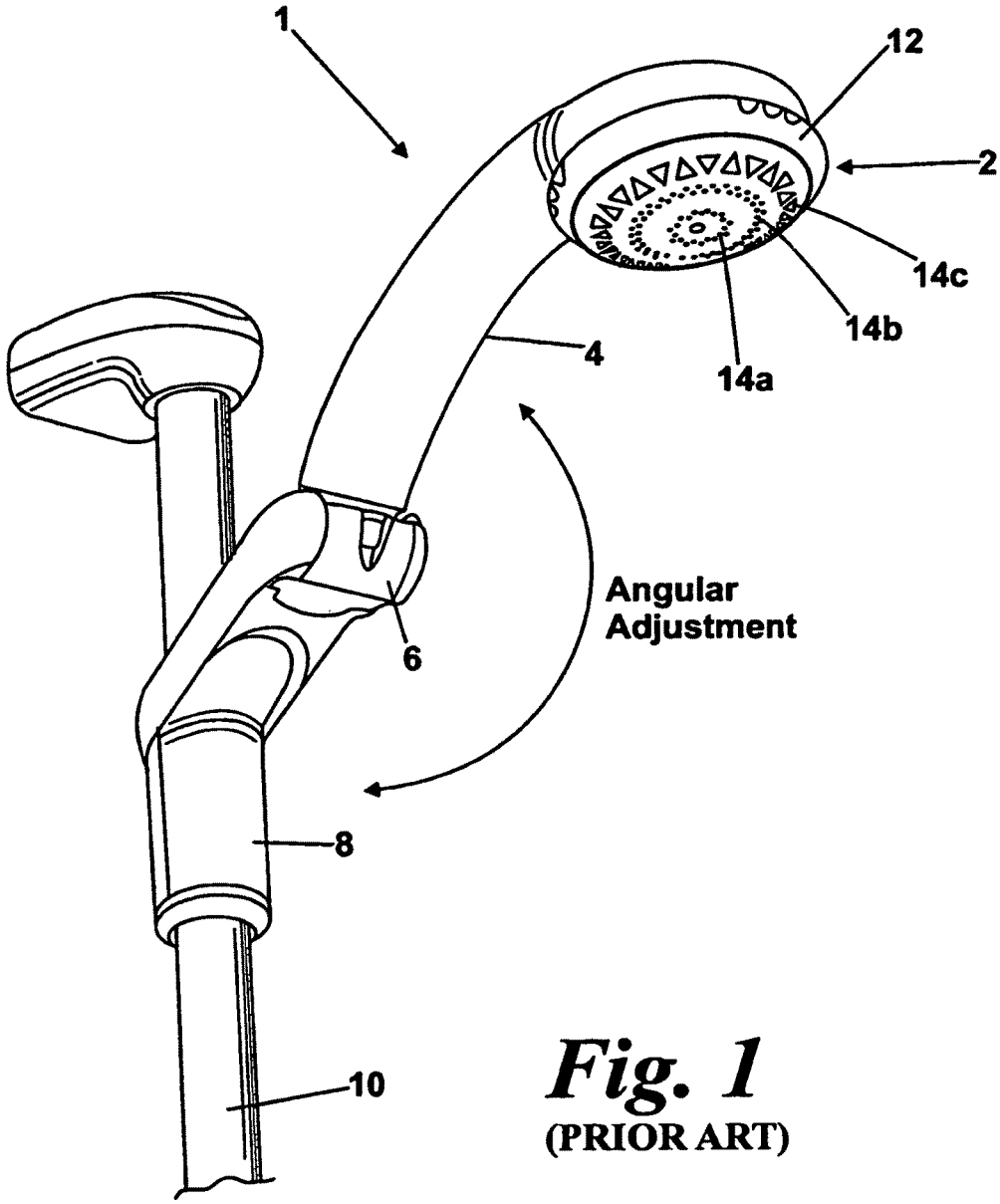
Fig. 1 (PRIOR ART)
FIG. 1 shows a prior art shower handset installation.
Figure 2:
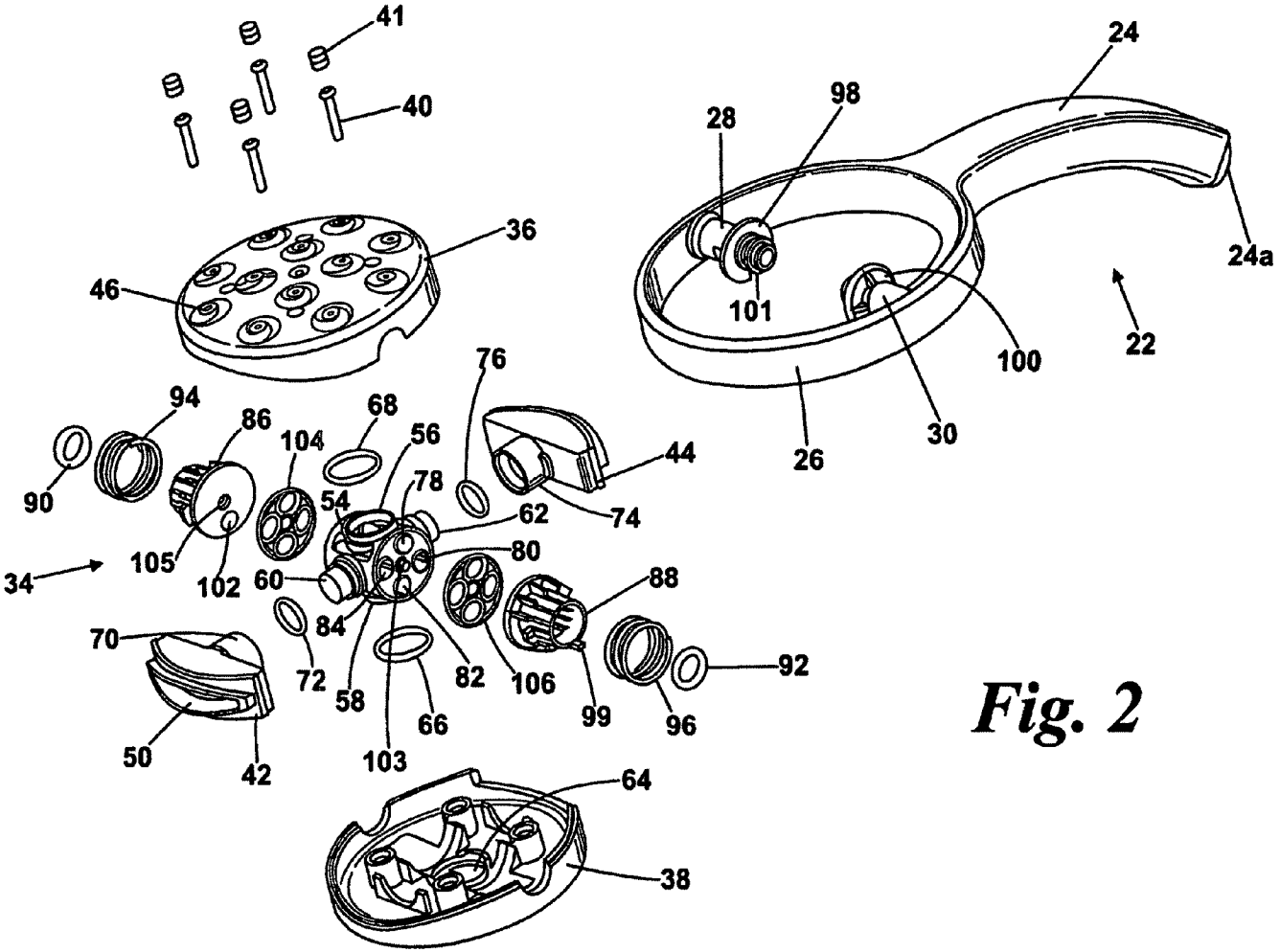
FIG. 2 is an exploded perspective view of a multi-mode showerhead according to a first embodiment of the present invention.

Referring first to FIG. 1 of the accompanying drawings, a typical prior art shower handset installation is shown comprising a handset 1 having a spray head 2 at one end of a handle portion 4. The other end of the handle portion 4 is adapted for connection to a flexible hose (not shown) for delivering water to the spray head 2 via a water supply passageway (not shown) within the handle portion 4. The end of the handle portion 4 remote from the spray head 2 is detachably located in a parking socket 6 for holding and supporting the handset 1. The parking socket 6 is pivotally connected to a support bracket 8 moveably mounted on a riser rail 10.

The support bracket 8 is slidable up and down the riser rail 10 to raise and lower the handset 1 to adjust the vertical height of the spray head 2 and the parking socket 6 is pivotal relative to the support bracket 8 to alter the angle of the handset 1 to adjust the direction of water flow from the spray head 2. The support bracket 8 can be secured at any desired position along the riser rail 10 by a friction clamp and the parking socket 6 is retained at any desired position relative to the support bracket 8 by a friction pivot.

The spray head 2 typically comprises a number of spray delivery chambers (not shown) that are selectively connectable to the water supply passageway by a valve mechanism (not shown) operable in response to rotation of a control ring 12 of the spray head 2 to direct water to a selected chamber from which the water is discharged through one or more spray nozzles. Three annular sets of spray nozzles 14*a*, 14*b*, 14*c* are shown corresponding to three different spray modes. As will be understood, with the above arrangement, the spray mode selection is obtained by rotation of the control ring 12 at the spray head 2 about an axis parallel to the direction of water flow from the spray head 2 in each mode and the angular adjustment of the direction of the spray is obtained by pivotal movement of the parking socket 6.

A showerhead in accordance with the present invention is shown in FIGS. 2 to 16 in the form of a handset 20. The handset 20 comprises a hollow body 22 having a handle or grip portion 24, and an annular, ring-shaped head portion 26 having a pair of opposed, inwardly directed hollow spigots 28,30 on which a spray head 32 is mounted for rotation about a pivot axis transverse to the longitudinal axis of the handle portion 24. The handle portion 24 has a threaded boss 24*a* at the end remote from the head portion 26 for connecting a flexible hose (not shown) to deliver water to the handset 20 from a source (not shown) of temperature controlled water such as a mixing valve or instantaneous water heater. An internal water supply passageway (not shown) in the handle portion 24 and head portion 26 delivers water to the spray head 32 via the spigots 28,30 and a spray selection module 34 located within the spray head 32. The spray head 32 is rotatable about the pivot axis to select one of four spray modes and to adjust the direction of the spray of the selected spray mode as described in more detail later.

The spray head 32 comprises a pair of annular, spray plates 36,38 secured together by a plurality of screws 40—in this embodiment four screws, although any number may be used—and a pair of spray cartridges 42,44 located opposite one another in the side edge of the spray head 32 between the spray plates 36,38. The heads of the screws 40 are received in counterbores in the outer face of the spray plate 36 and concealed by plugs 41 inserted into the counterbores. The plugs 41 may match the finish of the spray plate 36.

Each spray plate 36,38 has an array of holes 46,48 respectively through which water is discharged in the form of individual streams forming a desired spray according to the number, type and location of the holes 46,48. Each spray cartridge 42,44 has a slot 50,52 through which water is discharged in the form of a single stream forming a curtain spray according to the size and shape of the slots 50,52. Each array of holes 46,48 is different and each slot 50,52 is different providing four different sprays for selection by the user rotating the spray head 32.

Figures 3, 4, 5, 6, 7, 8, 9, 10:
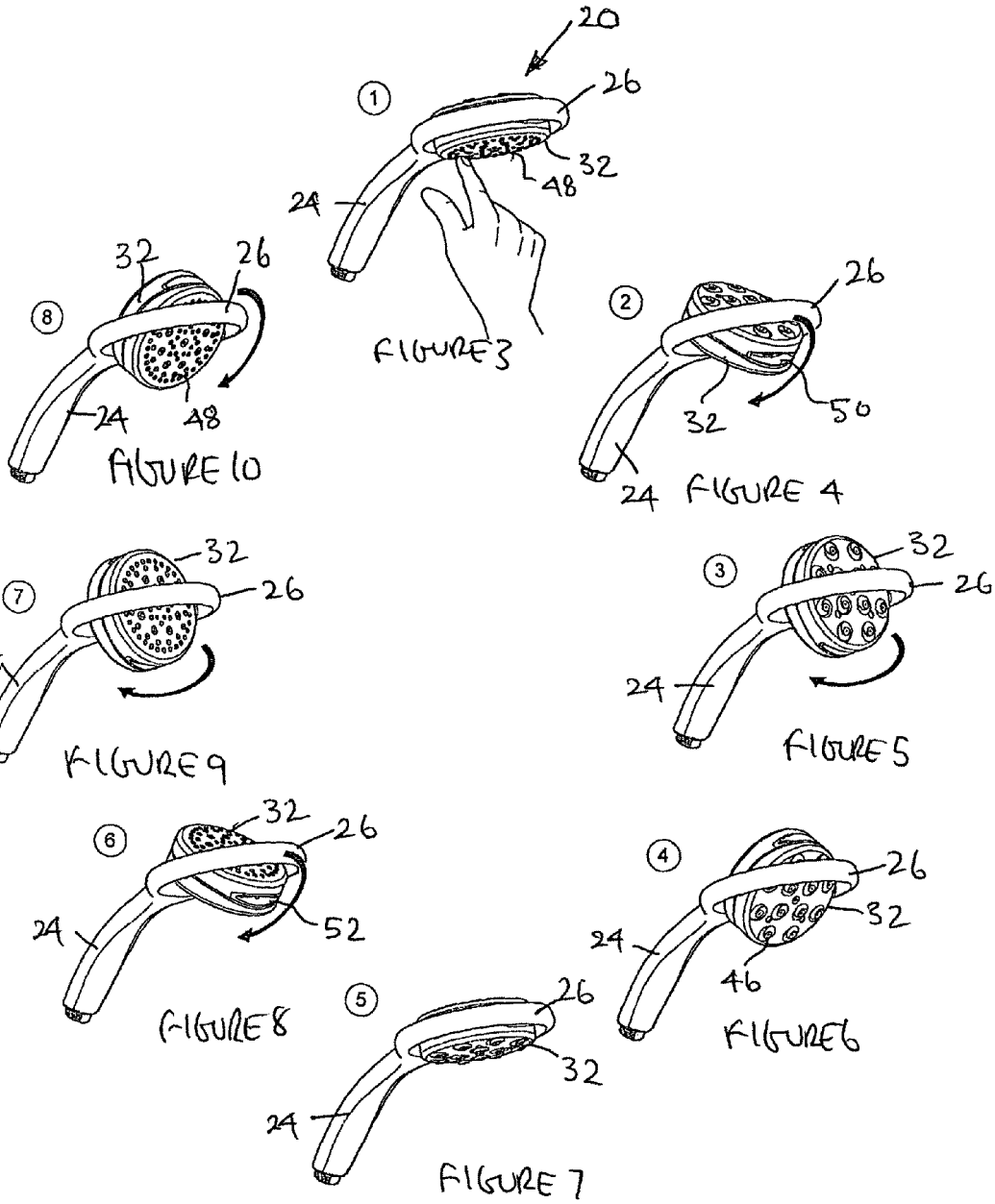
FIGS. 3 to 10 are perspective views the showerhead of FIG. 2 illustrating adjustment of the rotatable spray head to change the selected spray mode.

FIG. 3 shows the spray head 32 with the spray mode corresponding to the array of holes 48 in the spray plate 38 selected. The spray head 32 is rotatable from the position shown in FIG. 3 through the intermediate position shown in FIG. 4 to the position shown in FIG. 5 with the spray mode corresponding to slot 50 in cartridge 42 selected. The spray head 32 is rotatable from the position shown in FIG. 5 through the intermediate position shown in FIG. 6 to the position shown in FIG. 7 with the spray mode corresponding to the array of holes 46 in the spray plate 36 selected. The spray head 32 is rotatable from the position shown in FIG. 7 through the intermediate position shown in FIG. 8 to the position shown in FIG. 9 with the spray mode corresponding to slot 52 in cartridge 44 selected. The spray head 32 is rotatable from the position shown in FIG. 9 through the intermediate position shown in FIG. 10 to return to the position shown in FIG. 3 with the spray mode corresponding to the array of holes 48 in the spray plate 38 again selected. As will be appreciated, the spray head 32 can be rotated in either direction to select the desired spray mode. In this embodiment, the spray head 32 is rotatable through 90° between a centre position of each spray mode.

The spray selection module 34 includes a central hub 54 having two opposed outlet ports 56,58 for delivery of water to the spray plates 36,38 respectively and a further two opposed ports 60,62 for delivery of water to the spray cartridges 42,44 respectively. The ports 56,58,60,62 extend radially with respect to the pivot axis. The ports 56,58 are aligned and the ports 60,62 are aligned and normal to the ports 56,58.

The spray plate 38 has an inlet port 64 that is sealed relative to the outlet port 58 of the hub 54 by an O-ring 66 and opens to an inlet chamber (not shown) that communicates with the holes 48. The spray plate 36 has a similar inlet port (not shown) that is sealed relative to the outlet port 56 of the hub 54 by an O-ring 68 and opens to an inlet chamber (not shown) that communicates with the holes 46.

The cartridge 42 has a tubular inlet port 70 that is a push fit on the outlet port 60 of the hub 54 and is sealed relative to the port 60 by an O-ring 72. The cartridge 44 has a tubular inlet port 74 that is a push fit on the outlet port 62 of the hub 54 and is sealed relative to the port 62 by an O-ring 76. With this arrangement, the cartridges 42,44 can be detached from the hub 54 and replaced by cartridges having a different water outlet. For example, one or both cartridges may have a slot to provide a curtain spray. Alternatively, one or both cartridges may have an array of nozzles to provide individual sprays.

The hub 54 has four separate axial through bores 78,80,82,84 parallel to and offset from the pivot axis. The bores 78,80,82,84 extend between end faces of the hub 54 and communicate with the outlet ports 56,58,60,62 respectively. The hub 54 is located between the spray plates 36,38 and rotates with the spray head 32 relative to the spigots 28,30 on the head portion 26.

The spray selection module 34 further includes a pair of water diverters 86,88 mounted on and sealed relative to the spigots 28,30 respectively by O-rings 90,92 respectively. The diverters 86,88 are biased towards the end faces of the hub 54 by springs 94,96 respectively acting between the diverters 86,88 and flanges 98,100 on the spigots 28,30 respectively. Each diverter 86,88 has a tongue 99 (one only shown) that engages a notch 101 (one only shown) in the flange 98,100 of the associated spigot 28,30 to locate the diverters 86,88 against rotation relative to the spigots 28,30.

The diverter 86 has a port 102 offset from the pivot axis and the diverter 88 has a similar port (not shown) that is aligned with the port 102 in the assembled spray head 32. The hub 54 has a peg 103 at each end (one only shown) coaxial with the pivot axis that locates in a blind bore 105 (one only shown) of the adjacent diverter 86,88 and is rotatable relative to the diverters 86,88 in response to rotation of the spray head 32 to select one of the four spray modes in which the bore 78,80,82,84 corresponding to the selected spray mode aligns with the diverter ports 102 (one only shown) to deliver water to the selected spray outlet. A gasket 104 is provided between the diverter 86 and the end face of the hub 54 and has apertures aligned with the bores 78,80,82,84 to provide a seal between the diverter 86 and hub 54 in all angularly adjusted positions of the hub 54. A similar gasket 106 is provided between the diverter 88 and the opposite end face of the hub 54.

Figure 12:
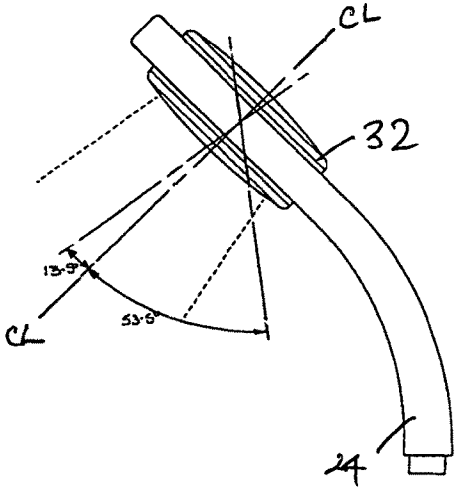
Figure 15:
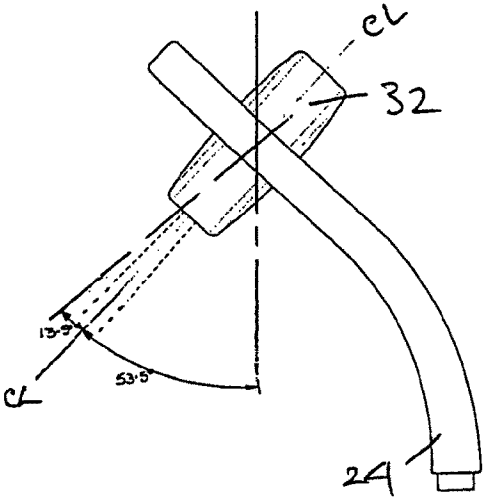

The diverter ports 102 (one only shown) and hub bores 78,80,82,84 are arranged to permit a range of angular movement of the spray head in the selected spray mode to alter the direction of the spray from the selected spray outlet without overlapping the hub bore of an adjacent spray outlet so as to maintain a full spray from the selected spray outlet. FIG. 12 shows the permitted range of angular movement of the spray head 32 about a centre position to adjust the direction of spray from a selected spray plate 36 (or 38) while maintaining a full spray. FIG. 15 shows the permitted range of angular movement of the spray head 32 about a centre position to adjust the direction of spray from a selected spray cartridge 42 (or 44) while maintaining a full spray. As shown, a full spray is maintained for a range of movement of the spray head of 13.5° above a centre line CL of the spray plate 36 (or 38)—FIG. 12—or spray cartridge 42 (or 44)—FIG. 15—and of 53.5° below the centre line CL of the spray plate 36 (or 38)—FIG. 12—or spray cartridge 42 (or 44)—FIG. 15—giving a total range of angular movement of the spray head of 67° in which a full spray is obtained in each mode.

Figure 13:
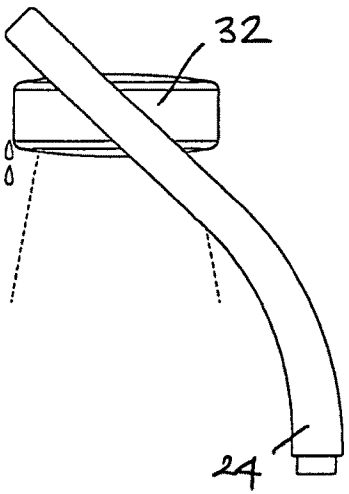
FIGS. 11 to 16 are side views of the showerhead of FIG. 2 illustrating adjustment of the rotatable spray head to change the direction of spray in each of the spray modes.
Figure 11:
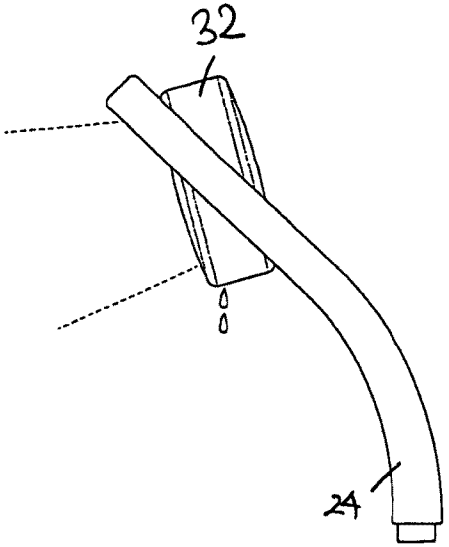
Figure 16:
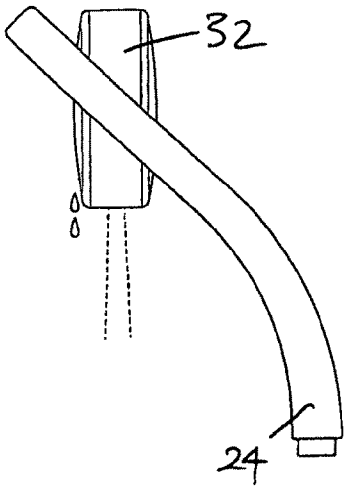
Figure 14:
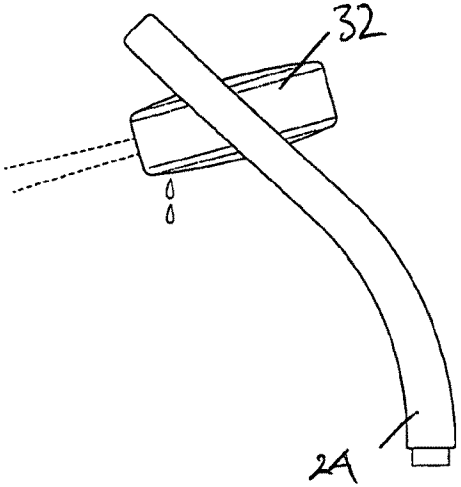

When the spray head is rotated beyond the permitted range of angular movement for a selected spray outlet, the hub bore of the next spray outlet in the direction of rotation of the spray head 32 starts to overlap the diverter ports 102 before the hub bore of the selected spray outlet clears the diverter ports 102. As a result, flow of water gradually decreases from the selected spray outlet and gradually increases from the next spray outlet in the direction of rotation until the spray head 32 is rotated sufficiently to position the spray head 32 within the permitted range of angular adjustment of the next spray outlet so that water is discharged from the next spray outlet only. In this way, the flow of water is not interrupted during changeover from one spray outlet to the next spray outlet such that the handset can be used where a continuous flow of water is required to maintain safe operation, for example with instantaneous water heaters or combination boilers. FIGS. 11 and 13 show rotation of the spray head 32 in opposite directions from the position shown in FIG. 12 so that water starts to flow from a spray cartridge 42 or 44 while still flowing from the spray plate 36 or 38. FIGS. 14 and 16 show rotation of the spray head 32 in opposite directions from the position shown in FIG. 15 so that water starts to flow from a spray plate 36 or 38 while still flowing from the spray cartridge 42 or 44.

In this embodiment, the range of movement either side of the centre line to provide a full spray is 67° for all of the spray outlets—spray plates 36,38 and spray cartridges 42,44—and there is a range of movement of 23° between adjacent spray outlets during which there is flow from both outlets before the flow changes over to provide a full spray from the next spray outlet in the direction of rotation. It will be understood that the range of movement providing a full spray in each mode is exemplary only and that changes can be made thereto within the scope of the invention. For example, angular movement above the centre line CL providing a full spray in each mode may be in the range of 5° to 20°, and preferably 10° to 15° with a range of 13° to 14°, more especially 13.5°, most preferred. Similarly angular movement below the centre line CL providing a full spray in each mode may be in the range of 45° to 60°, and preferably 50° to 55° with a range of 53° to 54°, more especially 53.5°, most preferred. The overall range of movement providing a full spray in each mode may vary from 50° to 80°, and preferably from 60° to 75° with a range of 65° to 70°, more especially 67°, most preferred. In general, the range of movement providing a full spray below the centre line CL is larger than the range of movement providing a full spray above the centre line CL and typically the ratio of the range of movement below the centre line to that above the centre line is at least 2:1, more preferably at least 3:1 and is most preferably of the order of 4:1.

The range of movement providing a full spray may be the same for each mode but this is not essential and the range of movement providing a full spray may be different for different modes. For example, in the above-described embodiment, the spray plates 36,38 may provide a full spray over a larger range of movement than the spray cartridges 42,44 or vice versa. The spray plates 36,38 may provide a full spray over the same range of movement or different ranges of movement. The spray cartridges 42,44 may provide a full spray over the same range of movement or different ranges of movement. A wide range of combinations can be achieved by appropriate configuration of the spray selection module 34.

In the above-described embodiment, the spray head 32 is rotatable through 360° in both clockwise and anti-clockwise directions and is retained in any adjusted position by friction between the hub 34 and the diverters 86,88 under the biasing of the springs 94,96. Any other means for retaining the spray head 32 in an adjusted position may be employed.

By providing four spray outlets with adjacent spray outlets at right angles, spray from the spray head 32 can be prevented from spraying in an upwards direction during changeover from one spray mode to another to prevent water spraying outside a shower area such as a shower enclosure or a bath. In particular, maximum flow from a selected spray outlet is achieved when the diverter ports 102 are aligned with the hub bore 78,80,82,84 associated with the selected spray outlet and is reduced as the spray outlet is rotated beyond the range of angular adjustment to change the spray mode thereby reducing the range of the spray generated by the reduced flow.

In the above-described embodiment, the spray head 32 has a first pair of spray outlets provided by the spray plates 36,38 and a second pair of spray outlets provided by the spray cartridges 42,44 that are normal to the first pair of spray outlets and both pairs of spray outlets are normal to the pivot axis of the spray head 32.

As will be appreciated, in the above-described multi-mode handset, the spray head 32 is rotatable about a pivot axis transverse to the longitudinal axis (centre line) of the handle portion 24 to select a desired spray mode and/or to change the direction of the spray for a selected spray mode. In a modification (not shown, the spray head 32 may be rotatable about a pivot axis parallel to the longitudinal axis (centre line) of the handle portion 24. Alternatively, the pivot axis of the spray head 32 may be located at a position intermediate these positions.

In another modification (not shown), the head portion 26 may be rotatable relative to the handle portion 24 about a pivot axis parallel to the longitudinal axis (centre line) of the handle portion 24. This may be in addition to the rotation of the spray head 32 relative to the head portion 26 as described above allowing the angular orientation of the spray head 32 to be adjusted about two axes.

In a further modification (not shown), one or preferably both of the spray plates 36,38 may be replaced by detachable spray cartridges releasably secured by any suitable means. In this way, any of the spray modes can be changed by selection and fitment of an appropriate spray cartridge allowing spray heads to be configured to provide any desired combination of spray modes. Where an outlet is provided by a spray cartridge, the spray cartridge itself may also be adjustable to provide more than one spray mode. Such spray cartridges are preferably detachable but may not be detachable or at least not readily detachable.

In the above-described embodiment, water is fed into the spray selection module 34 by means of two flow passageways feeding water into both ends of the module from a pair of spigots 28,30. It is envisaged that an alternative embodiment may comprise a single water feed to the spray selection module from one of the spigots. In this alternative embodiment, the other spigot may be omitted. Similarly, in the above-described embodiment, the spray selection module has four ports for selecting four spray modes but this may be varied to provide more ports or fewer ports according to the number of spray modes without departing from the invention. For example, we may provide two spray modes comprising a spray outlet on one side of the spray head and another spray outlet in a side edge of the spray head substantially normal to each other and to the pivot axis of the spray head. We may provide three spray modes comprising a spray outlet on one side of the spray head and two spray outlets in a side edge of the spray head opposite one another and substantially normal to the spray outlet on one side with the spray outlets also normal to the pivot axis of the spray head. Alternatively, we may provide three spray modes comprising a spray outlet on each side of the spray head and a further spray outlet in a side edge of the spray head substantially normal to the spray outlets on each side with the spray outlets also normal to the pivot axis of the spray head. We may provide more than four spray modes. For example with may provide a spray head having more than four sides, for example, pentagonal, hexagonal etc, with a spray outlet in each side where the spray head is rotatable to select a spray outlet and/or to change the direction of the spray of the selected spray outlet.

Figure 17:
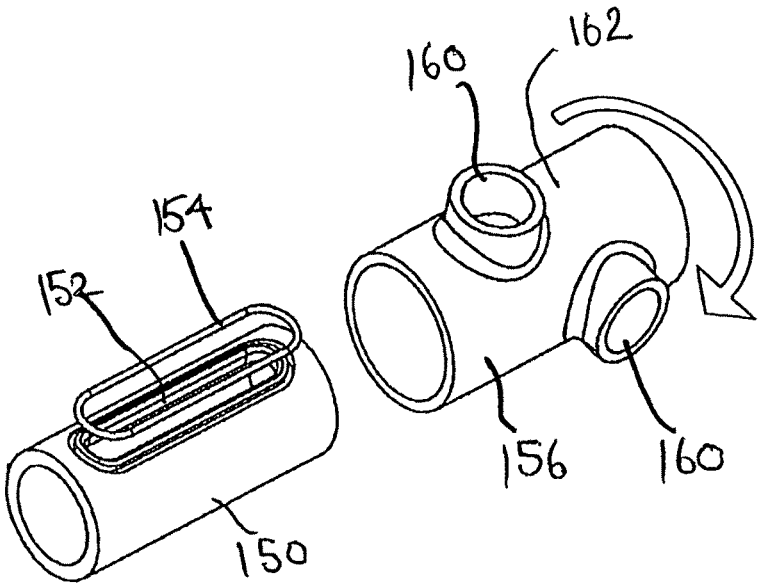
FIG. 17 is an exploded perspective view of an alternative spray selection module.

An alternative spray selection module is shown in FIG. 17 and comprises a cylindrical element 156 associated with the spray head (not shown) and mounted for rotation on a cylindrical arm 150 that defines a pivot axis for the spray head and is in communication with the water supply passageway in the handset. The arm 150 is provided with an elongate port 152 extending longitudinally of the arm and is bounded by a sealing ring 154 that provides fluid-tight seal between the arm 150 and the element 156.

The element 156 has a number of outlets provided as annular ports 160 on an outer face 162 of the cylinder. The ports 160 are offset relative to each other in the axial and/or circumferential direction to align selectively with the port 152 as the element 156 rotates to direct water flow through a selected port 160 to a corresponding spray outlet such as the nozzles or slot described previously. The ports 152 and 160 are configured so that port 152 does not overlap successive ports 160 when rotating element 156 to change the port 160 aligned with the port 152. As a result, water flow is interrupted when changing over the flow path to select a different spray mode. In other respects, the operation of this embodiment to change the spray mode and/or the direction of spray will be understood from the description of the previous embodiment.

Figure 18:
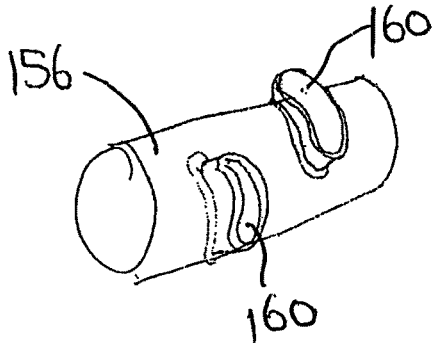
FIG. 18 shows a modification to the spray selection module of FIG. 17.

Referring now to FIG. 18, there is shown a modification of FIG. 17 in which like reference numerals are used in to indicate corresponding parts. In FIG. 18, the configuration of the ports 160 in the element 156 is changed from annular to elliptical so that port 152 overlaps successive ports when rotating the element 156 to change the port 160 aligned with the port 152. As a result, water continues to flow when changing over the flow path to select a different spray mode. In other respects, the operation of this embodiment to change the spray mode and/or the direction of spray will be understood from the description of the previous embodiments.

Figure 19:
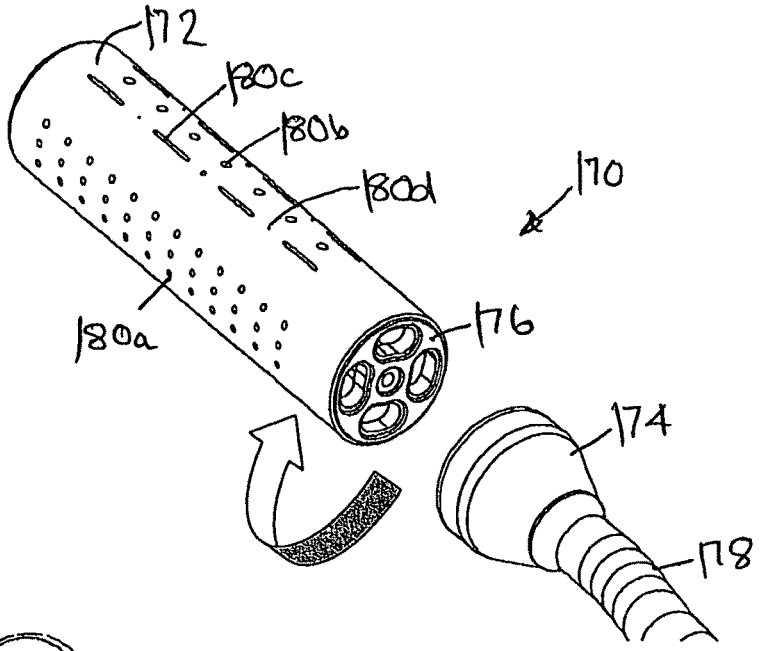
FIG. 19 is an exploded perspective view of a multi-mode showerhead according to a second embodiment of the invention.
Figure 20:
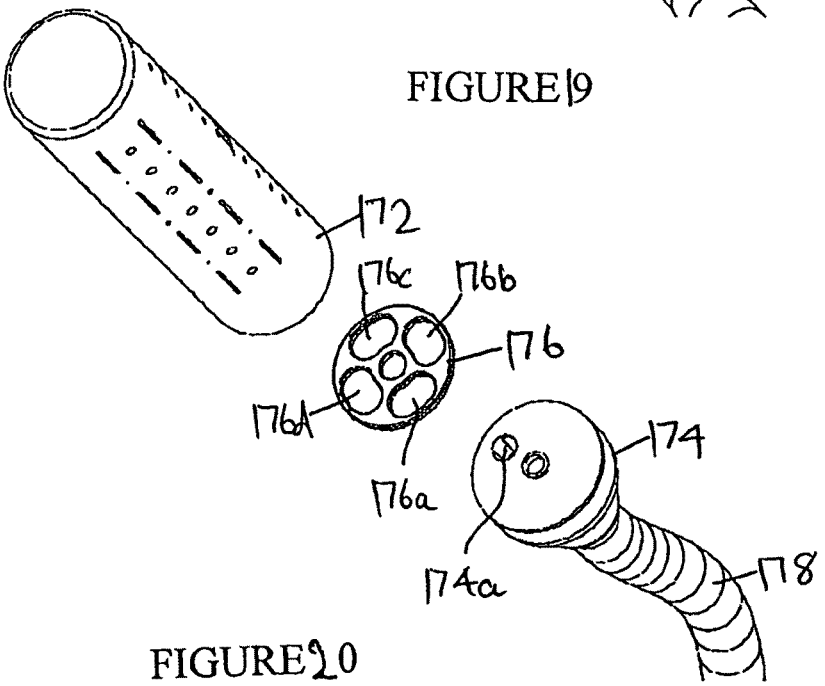
FIG. 20 shows a detail of the showerhead shown in FIG. 19.

Referring now to FIGS. 19 and 20, there is shown another showerhead 170 embodying the invention. In this embodiment, the showerhead 170 comprises a cylindrical spray head 172 connected at one end to a water supply fitting 174 by means of a coupling pin (not shown) that allows rotation of the spray head 172 relative to the water supply fitting 174 about the longitudinal axis of the spray head 172.

Internally, the spray head 172 is divided into four longitudinally extending chambers by partition walls (not shown) that separate the chambers. In this embodiment, the chambers are of equal size so that each chamber extends circumferentially over 90° of the outer surface of the spray head 172. It will be understood, however, that any number of chambers may be provided and that these may be of the same or different size.

A spray selector plate 176 is provided at the end of the spray head 172 that is secured to the water supply fitting 174. The spray selector plate 176 has four circumferentially spaced ports 176*a*, 176*b*, 176*c*, 176*d*—one for each chamber—of generally elliptical shape offset from the rotational axis of the spray head 172.

The water supply fitting 174 is connected to a flexible water supply hose 178 and is provided with an annular delivery port 174*a* offset from the rotational axis of the spray head 172. In use, the spray head 172 is rotatable about its longitudinal axis relative to the water supply fitting 174 to align selectively the ports 176*a*, 176*b*, 176*c*, 176*d* with the annular delivery port 174*a* to supply water to the associated chamber.

Each chamber is provided with an array of openings in the outer surface of the spray head 172 through which water supplied to the chamber can be discharged to form a spray pattern according to the number, size, shape and pattern of the holes. Two arrays are shown in the drawings for the chambers provided with the ports 176*a*, 176*b*. One array consists of a plurality of rows of uniformly spaced annular holes 180*a* of equal size. The other array consists of a row of uniformly spaced annular holes 180*b* of equal size between two rows of uniformly spaced elongate holes 180*c* (slots) of equal size that alternate with annular holes 180*d* of smaller size than the holes 180*b*. The arrays will produce different spray patterns. The other chambers are provided with different arrays of openings to provide additional alternative spray patterns. Any size or shape of openings may be employed.

The delivery port 174*a* is sized to overlap any two adjacent ports 176*a*, 176*b*, 176*c*, 176*d* as the spray head 172 is rotated to ensure that water continues to flow when changing over from one spray type to another. In a modification (not shown), the ports 176*a*, 176*b*, 176*c*, 176*d* may be arranged so that the flow of water is cut-off when changing over from one spray type to another. As shown, the ports 176*a*, 176*b*, 176*c*, 176*d* are larger than the delivery port 174*a* and allow angular adjustment of the direction of flow of water discharged from the array of openings associated with each port 176*a*, 176*b*, 176*c*, 176*d*.

In this embodiment, the flexible hose 178 is self-supporting and can be configured to change the position of the spray head 172 to direct the water discharged from the selected array of holes as desired. This is not essential however and the spray head 172 and water delivery fitting 174 could form a handset for mounting in a parking socket similar to FIG. 1. Alternatively, the spray head 172 and water delivery fitting 174 could form a fixed spray head for mounting on a wall. Although the spray head 172 is cylindrical in this embodiment, it will be understood that spray heads having other shapes could be employed to operate in similar manner.

Referring now to FIGS. 21 to 28 another showerhead 190 is shown embodying the invention. In this embodiment, the showerhead 190 comprises an outer rectangular support frame 192 configured to be mounted in a rectangular opening in a wall, ceiling or similar surface and an inner rectangular spray head 194 mounted in the frame 192 on a pair of hollow spigots (not shown) for rotational movement about a pivot axis extending between opposed side edges of the spray head 194 mid-way between the ends of the spray head 194. The showerhead 190 may be mounted so as to be substantially flush with the surrounding surface finish, for example a tiled surface, and the frame 192 may be of a size and shape similar to a tile. In a modification (not shown), the pivot axis may extend between the ends of the spray head 194. In another modification (not shown) the support frame 192 and/or spray head 194 may have shapes other than rectangular, for example annular. The support frame 192 and spray head 194 may have the same or different shapes.

The spray head 194 is connected to a source (not shown) of temperature controlled water such as a mixing valve or instantaneous water heater via the spigots and a spray selection module (not shown) located within the spray head 194. The spray head 194 is rotatable about the pivot axis to select one of four spray modes and to adjust the direction of the spray of the selected spray mode as described in more detail later. The arrangement of the spigots and spray selection module may be similar to that described previously for the embodiment of FIGS. 2 to 16.

The spray head 194 is provided on one side with a spray plate 196 having an array of openings comprising uniformly spaced annular holes 198 of equal size arranged in a plurality of rows. On the other side the spray head 194 has a spray plate 200 with an array of openings comprising holes 202 of equal size arranged in four groups, one at each corner, with the holes 202 uniformly spaced in rows. The arrays produce different sprays. The spray head 194 is also provided at the ends with a pair of spray cartridges 204,206 in the side edges between the spray plates 196,200 that provide different sprays. In this embodiment, one of the spray cartridges 204 has a single slot 208 providing a curtain spray and the other spray cartridge 206 has a linear array of spray holes 210—in this embodiment three spray holes although it will be understood the number of holes may be more or less than three and may be arranged in a linear array or any other array as desired. The spray cartridges 204,206 are preferably detachable as described previously.

Figures 21, 22, 23, 24, 25, 26, 27, 28:
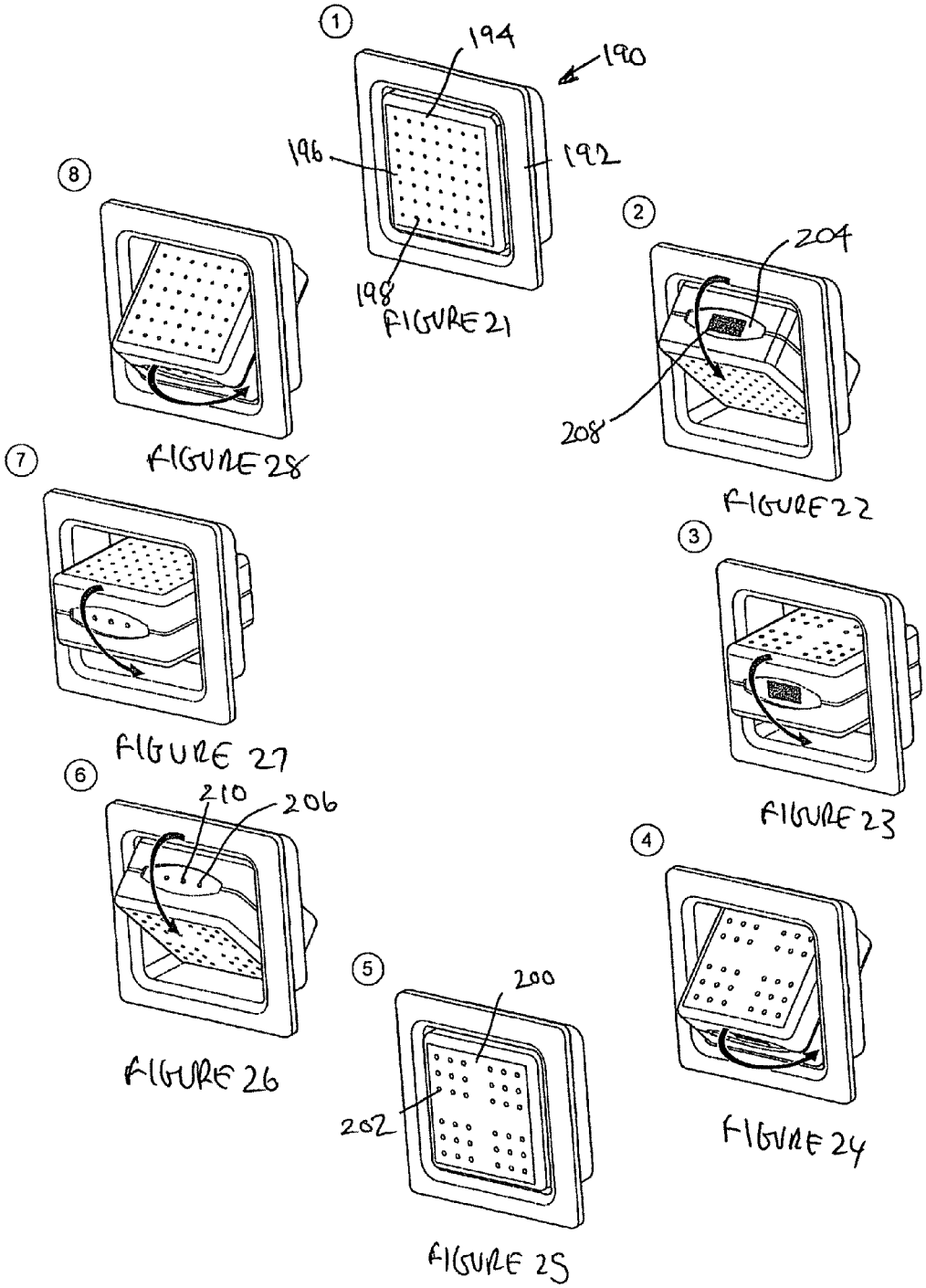
FIGS. 21 to 28 are perspective views of a multi-mode showerhead according to a third embodiment of the invention and illustrating adjustment of the rotatable spray head to change the selected spray mode.
Figure 29:
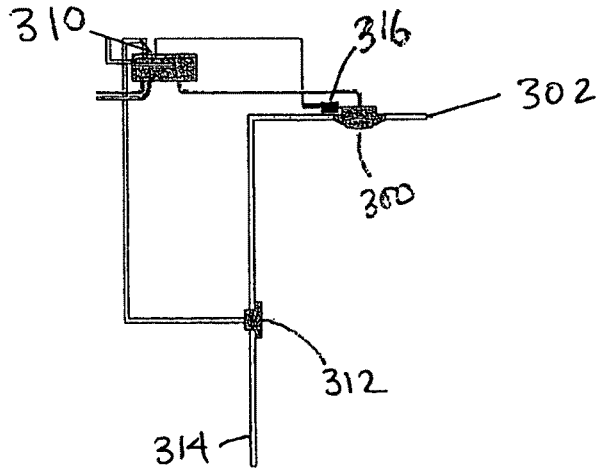
FIG. 29 is a schematic view of a shower installation employing a multi-mode showerhead according to a fourth embodiment of the invention.
Figure 30:
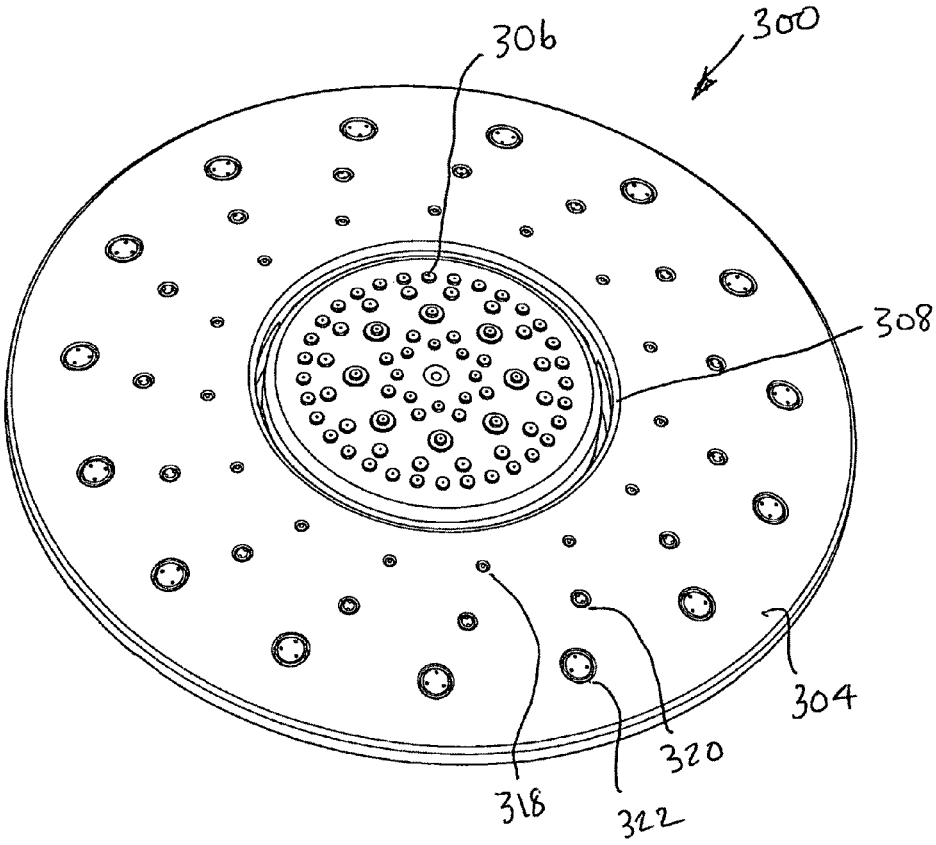
FIG. 30 is a perspective view of the showerhead of FIG. 29 with the rotatable spray head in a selected spray mode.
Figure 31:
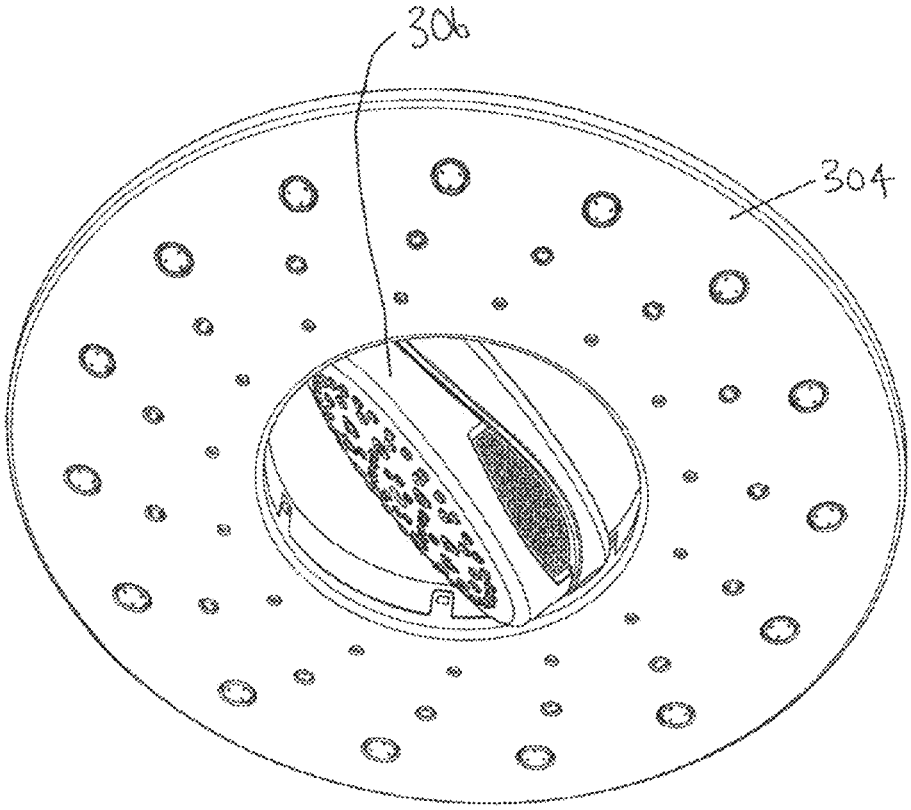
FIG. 31 is a perspective view of the showerhead of FIG. 30 illustrating adjustment of the spray head to change the selected spray mode.

FIG. 21 shows the spray head 194 with the spray mode corresponding to the array of holes 198 in the spray plate 196 selected. The spray head 194 is rotatable from the position shown in FIG. 21 through the intermediate position shown in FIG. 22 to the position shown in FIG. 23 with the spray mode corresponding to slot 208 in cartridge 204 selected. The spray head 194 is rotatable from the position shown in FIG. 23 through the intermediate position shown in FIG. 24 to the position shown in FIG. 25 with the spray mode corresponding to the array of holes 202 in the spray plate 200 selected. The spray head 194 is rotatable from the position shown in FIG. 25 through the intermediate position shown in FIG. 26 to the position shown in FIG. 27 with the spray mode corresponding to spray holes 210 in cartridge 206 selected. The spray head 194 is rotatable from the position shown in FIG. 27 through the intermediate position shown in FIG. 28 to return to the position shown in FIG. 21 with the spray mode corresponding to the array of holes 198 in the spray plate 196 again selected. As will be appreciated, the spray head 194 can be rotated in either direction to select the desired spray mode. In this embodiment, the spray head 196 is rotatable through 90° between each spray mode.

As with the embodiment of FIGS. 2 to 16, the spray selection module is configured to allow the spray head 194 to be tilted in each spray mode to alter the angle at which the spray is discharged. Thus, the spray selection module permits a range of angular movement of the spray head 194 in the selected spray mode to alter the direction of the spray from the selected spray outlet to maintain a full spray without discharging water from any of the other spray outlets. If the spray head 194 is rotated beyond the permitted range of angular movement for a selected spray outlet, the spray selection module starts to deliver water to both the selected spray outlet and the next spray outlet in the direction of rotation of the spray head 194. As a result, flow of water gradually decreases from the selected spray outlet and gradually increases from the next spray outlet in the direction of rotation until the spray head 194 is rotated sufficiently to position the spray head 194 within the permitted range of angular adjustment of the next spray outlet so that water is discharged from the next spray outlet only. In this way, the flow of water is not interrupted during changeover from one spray outlet to the next spray outlet and the showerhead can be used with instantaneous water heaters or combination boilers where a continuous flow of water is required to maintain safe operation.

The permitted range of angular movement over which the direction of spray from the spray outlet of a selected spray mode can be adjusted until water starts to be discharged from the next spray outlet may be of the order of 50° to 80°, and preferably from 60° to 75° with a range of 65° to 70° most preferred. The range of movement either side of a centre position (FIGS. 21,23,25,27) may be the same, for example when the showerhead is mounted in the ceiling or may be different, for example when the showerhead is mounted in the wall. Thus, the showerhead may be mounted in the wall at different levels and the angular movement may be chosen to allow the user to adjust the position more to one side of the centre position than the other side so as to direct the spray to different parts of the body according to the position of the showerhead in the wall. The spray head 194 is rotatable through 360° in both clockwise and anti-clockwise directions and is retained in any adjusted position by friction or any other suitable means.

The multi-mode showerhead 190 of FIGS. 21 to 28 may include any of the modifications described previously in connection with the multi-mode handset of FIGS. 2 to 16 including, but not limited to a single water feed to the spray selection module from one of the spigots mounting the spray head. In this alternative embodiment, the other spigot may be omitted. Similarly, in the above-described embodiment, the spray selection module has four ports for selecting four spray modes but this may be varied to provide more ports or fewer ports according to the number of spray modes without departing from the invention. For example, we may provide two spray modes comprising a spray outlet on one side of the spray head and another spray outlet in a side edge of the spray head substantially normal to each other and to the pivot axis of the spray head. We may provide three spray modes comprising a spray outlet on one side of the spray head and two spray outlets in a side edge of the spray head opposite one another and substantially normal to the spray outlet on one side with the spray outlets also normal to the pivot axis of the spray head. Alternatively, we may provide three spray modes comprising a spray outlet on each side of the spray head and a further spray outlet in a side edge of the spray head substantially normal to the spray outlets on each side with the spray outlets also normal to the pivot axis of the spray head. We may provide more than four spray modes. For example with may provide a spray head having more than four sides, for example, pentagonal, hexagonal etc, with a spray outlet in each side where the spray head is rotatable to select a spray outlet and/or to change the direction of the selected spray.

One or more of the single showerheads of FIGS. 21 to 28 may be mounted in the wall or ceiling or other suitable surface. Alternatively or additionally, two or more spray heads may be mounted in a common support frame, for example side by side, providing a multiple showerhead for mounting in the wall and/or ceiling. The user can adjust individual or multiple showerheads to provide the same or different spray types.

In the above-described embodiments, the spray head is manually adjustable by the user to select the required spray mode and to adjust the direction of spray in the selected mode. For some applications, however, the user may find manual adjustment is difficult and/or time consuming. For example, a ceiling mounted spray head may be out of reach of some users while adjusting multiple spray heads may be slow.

Referring now to FIGS. 29 to 32 another showerhead is shown embodying the invention that allows the user to adjust the spray head remotely.

As shown, the showerhead 300 is mounted in the ceiling 302 of the shower area although this is not essential and the showerhead could be mounted in the wall. The showerhead 300 is of annular shape comprising an annular outer spray head 304 and an annular inner spray head 306 mounted within a central opening 308 in the outer spray head 304. The outer spray head 304 is fixed and the inner spray head 304 is mounted for rotational movement about a pivot axis to select one of four spray modes and/or to change the direction of spray of the selected spray mode. In a modification (not shown), the outer spray head 304 and/or inner spray head 306 may have shapes other than annular, for example rectangular. The outer spray head 304 and inner spray head 306 may have the same or different shapes. In another modification (not shown), the outer spray head 304 may replaced by a support frame similar to the embodiment of FIGS. 21 to 28.

In this embodiment, the showerhead 300 is supplied with temperature controlled water from a digital mixer valve 310 that can be located outside the shower area, for example in the ceiling. A user operable control interface 312 is mounted in the shower area on the wall 314 so as to be within reach of a user within the shower area. The control interface 312 includes suitable means for the user to select water temperature and optionally one or more other features such as flow rate, start and stop times, pause times as will be familiar to those skilled in the art.

The inner spray head 306 is rotatable by means of a stepper motor 316 and the control interface 312 includes means for the user to activate the stepper motor 316 via the power supply and control electronics (not shown) of the digital mixer valve 310 for the user to select the spray mode and/or to adjust the direction of spray in the selected spray mode. In a modification (not shown), the digital mixer valve may be replaced by another source of temperature controlled water and the stepper motor 312 provided with a separate power source and control electronics for controlling the inner spray head 306 in response to user actuation of the control interface.

The outer spray head 304 has a plurality of spray holes arranged in three concentric rings 318,320,322 with the size or number of the holes increasing from the inner ring 318 to the outer ring 322. This is not essential and the number, size and arrangement of the holes may be altered from that shown. The inner spray head 306 is similar to the spray head shown and described in FIGS. 2 to 16 and the construction of the inner spray head 306 to provide four spray modes as well as the modifications and changes that can be made to such spray head will be understood from the description of FIGS. 2 to 16.

The control electronics may allow the user to control selectively the supply of water from the digital mixer valve 310 to the outer spray head 304 and inner spray head 306 via the control interface 312. For example, the user may select supply of water to both spray heads 304,306 at the same time or to one spray head only—the inner or outer spray head. The user may be able to select different combinations and/or sequences for the supply of water to the spray heads 304,306. For example, water may be supplied to both spray heads in response to selection of a spray mode corresponding to a spray plate on one side of the inner spray head 306 while water may be supplied to the inner spray head only in response to selection of a spray mode corresponding to a spray cartridge in a side edge of the inner spray head 306. These are provided by way of non-limiting example only and all sequences and/or combinations of sprays that can be achieved are within the scope of the invention.

Figure 32:
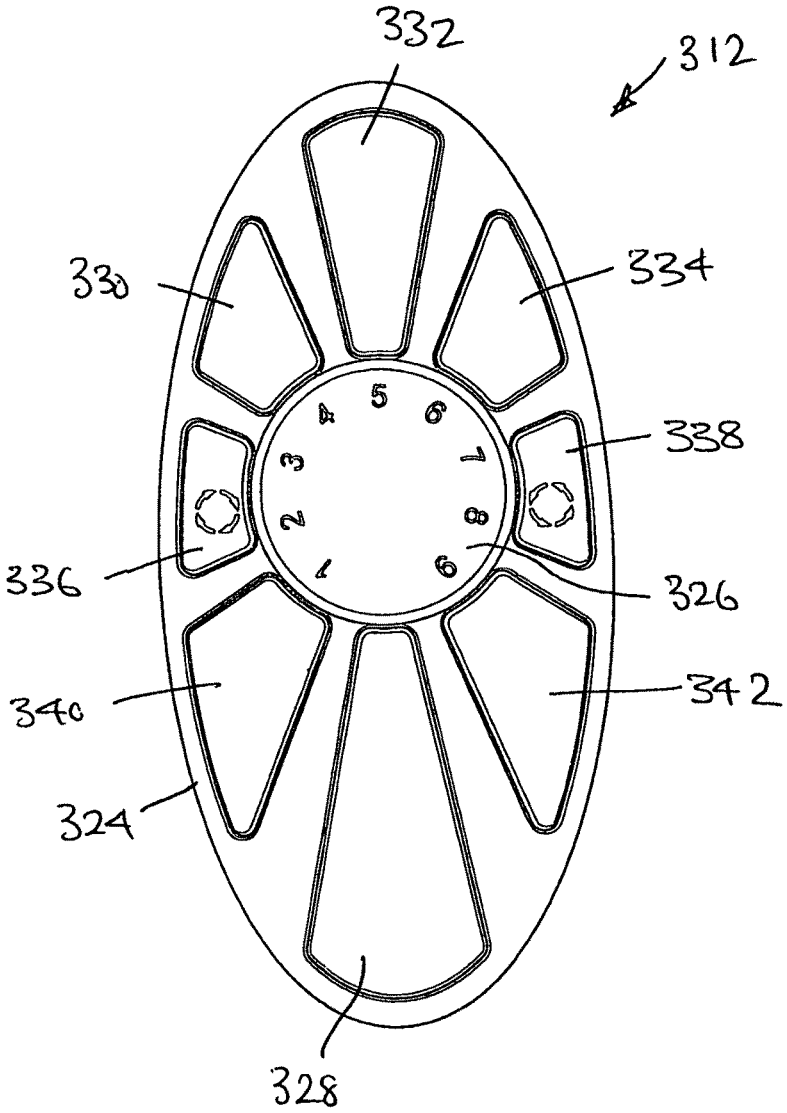
FIG. 32 is a front view of a control interface for the shower installation of FIG. 29.

One suitable control interface 312 for use with the showerhead 300 is shown in FIG. 32 and comprises a control panel 324 provided with a rotatable knob 326 for user selection of the water temperature and an array of eight push buttons 328,330,332,334,336,338,340,342 for user selection and control of different functions of the showerhead. Push button 328 is an on/off button that may be used to pause the flow of water. Push buttons 330,332,334 control the flow rate and allow selection of three different flow rates, for example high, medium and low. Push buttons 336,338 control the direction of rotation of the inner spray head 306 when changing the spray mode by rotating the spray head 306 in clockwise or anticlockwise directions. The push buttons 336,338 may provide indexing movement of the inner showerhead 306 by activating the stepper motor to rotate the inner showerhead to the centre position of the next spray mode in the selected direction of rotation for each actuation of the push button 336,338. Alternatively, the stepper motor may be activated to rotate the inner spray head 306 only while the push button 336,338 is actuated. Push button 340 may provide adjustment of the angular position of the inner spray head 306 in the selected spray mode. Push button 342 may provide continuous sweeping movement of the inner spray head 306 back and forth over the permitted range of angular movement of the inner spray head 306 for the selected spray mode. These are examples only of the possible functions and the control panel 324 may include other buttons or knobs to control other functions of the showerhead.

In the previous embodiments, the spray selection module is configured so that water is discharged from one or more spray outlets throughout the range of rotational movement of the rotatable spray head, i.e. the flow of water is not interrupted by rotation of the spray head and the spray head can be used with sources of temperature controlled water requiring a continuous flow of water. In the embodiment of FIGS. 29 to 32, however, it will be understood that supply of the water to the inner spray head 306 of the showerhead 300 can be interrupted in a selected spray mode and/or during changeover from one spray mode to another spray mode if the outer spray head 304 is supplied with water at the same time. For example, the water supply to the inner spray head 306 can be interrupted in a selected spray mode if the user selects the outer spray head 304 only or if the outer spray head 304 is supplied with water at all times. Alternatively or additionally, the water supply to the inner spray head 306 can be interrupted during changeover from one spray mode to another spray mode if the outer spray head 304 is provided with water at all times or if the outer spray head 304 is supplied with water in response to rotation of the inner spray head 306 beyond the permitted range in a selected spray mode so that water to the inner spray head 306 is interrupted. Such operation may be achieved via the control electronics.

As will be appreciated the motorised embodiment of FIGS. 29 to 32 is particularly suited to installations in which the showerhead is located in a position where manual rotation of the spray head by certain users may be prevented or inhibited. It is also beneficial to installations having a plurality of rotatable spray heads arranged individually in separate showerheads or grouped together in a single showerhead by allowing the user to control each spray head independently of the other spray heads or in combination with one or more other spray heads of the same or another showerhead.

Figure 34:
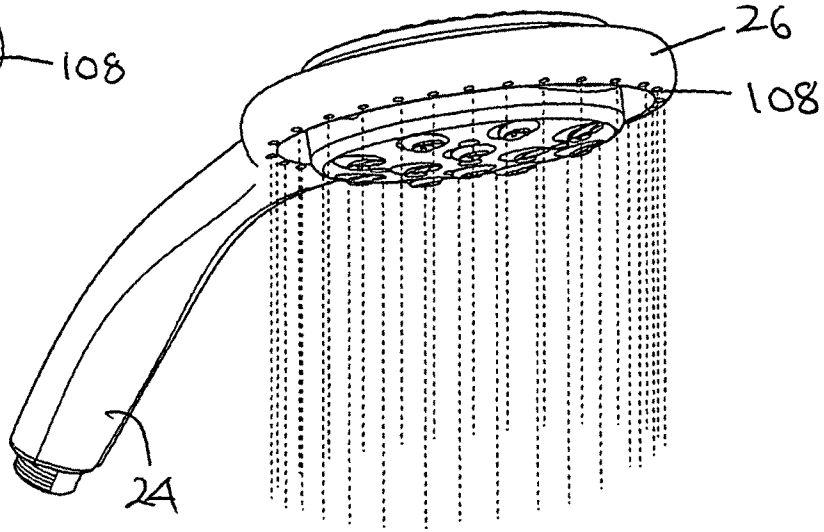
FIG. 34 is a perspective view similar to FIG. 33 showing water flow from holes in the head portion of the showerhead.
Figure 33:
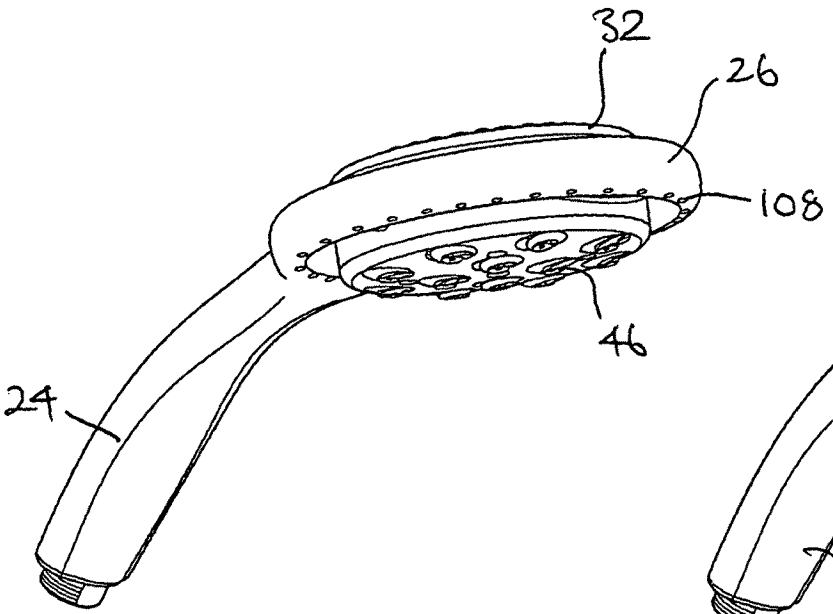
FIG. 33 is a perspective view showing a modification to the showerhead of FIGS. 2 to 16.

In the previous manually operable embodiments of the invention, the water supply to the rotatable spray head is uninterrupted for all angularly adjusted positions of the spray head. It will be understood however, that the water flow can be interrupted if the showerhead is provided with a spray outlet that, in use, is supplied with water at all times irrespective of the position of the rotatable spray head and/or in response to rotation of the rotatable spray head to changeover the selected spray mode. For example, in the embodiment of FIGS. 2 to 16 the head portion 26 of the showerhead 20 may be provided with an outlet such as one or more holes through which water can flow at all times. Similarly, in the embodiment of FIGS. 21 to 28, the support frame 192 may be provided with an outlet such as one or more holes through which water can flow at all times. Where provided, the outlet in the head portion 26 or support frame 192 preferably comprises a plurality of holes that extend around substantially the entire perimeter of the rotatable spray head. FIGS. 33 and 34 show a modification of the handset of FIGS. 2 to 16 for this purpose where the head portion 26 is provided with a plurality of holes 108 that extend around substantially the entire perimeter of the rotatable spray head 32 through which water can flow at all times irrespective of the position of the spray head 32. In this arrangement, flow of water through the spray head 32 can be interrupted during changeover between spray modes while still providing water flow through the holes 108. Alternatively, flow of water may be provided through spray head 32 and the holes 108 at all times.

In a modification (not shown) flow of water through the holes 108 may be controlled so as to be provided during changeover between spray modes only when flow of water through the spray head 32 is interrupted and to be interrupted in a selected spray mode when flow of water through the spray head 32 is permitted. In another modification (not shown), flow of water through the holes 108 may be provided during changeover between spray modes and in a selected spray mode. For example, flow of water through the holes 108 may be provided during changeover between spray modes when flow of water from the spray head 32 is interrupted and with flow of water through the spray plates 36 or 38 but not with flow of water through the spray cartridges 42,44.

Figure 35:
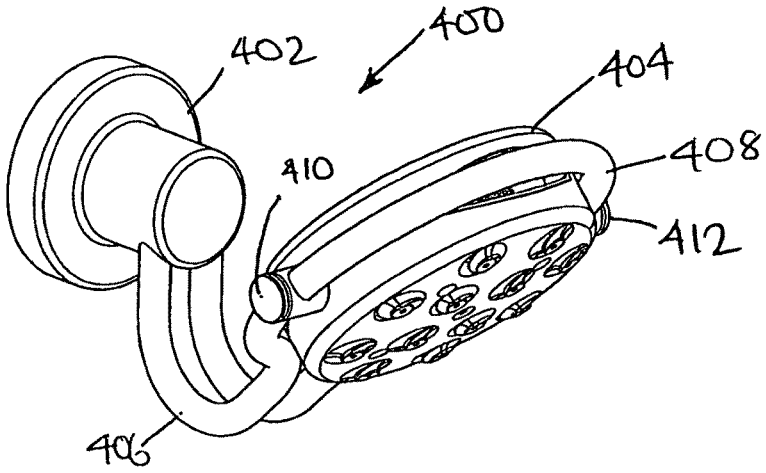
FIG. 35 is a perspective view of a multi-mode showerhead according to a fourth embodiment of the invention.
Figure 36:
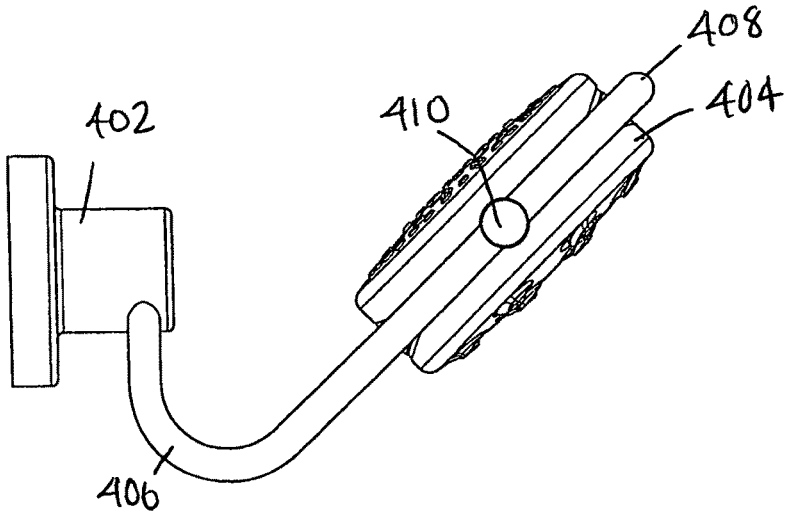
FIG. 36 is a side view of the showerhead shown in FIG. 35.

Referring now to FIGS. 35 and 36, a fixed showerhead 400 according to another embodiment of the invention is shown. In this embodiment, the showerhead 400 has a body 402 for mounting on a support surface such as a wall (not shown) and a rotatable spray head 404. The spray head 404 is similar to the spray head 32 described previously in connection with FIGS. 2 to 16 and the construction and operation including modifications thereto will be understood from the description of FIGS. 2 to 16 and modifications thereof.

In this embodiment, the body 402 is fixed to the support surface and has an inlet (not shown) for connection to a water supply pipe (not shown). The inlet may be accessible from the rear of the body for concealed connection to the water supply pipe through the support surface.

Alternatively, the body 402 may have an inlet for connection to a rising or falling surface mounted supply pipe. The body 402 may be a casting or machining of metal or alloy. Alternatively, the body 402 may be a plastics moulding with an appropriate surface finish.

The body 402 is provided with a hollow support arm 406 having an annular, ring-shaped head portion 408 with a pair of opposed, inwardly directed hollow spigots 410,412 on which the spray head 404 is mounted for rotation about a pivot axis to select a desired spray mode and/or to adjust the inclination of the spray head 404 in the selected spray mode as described previously for the spray head of FIGS. 2 to 16.

In this embodiment, the support arm 406 is formed from a hollow pipe or tube bent to the required shape. The ends of the pipe are connected to the body 402 and are in fluid communication with the inlet to deliver water to the spray head 404. As shown the support arm 406 is generally V-shaped in side elevation so that the head portion 408 is spaced from the body 402 and is inclined at an angle of approximately 45° to the support surface such that, in a selected spray mode, water is discharged from the spray head 404 in a downwards direction away from the support surface. It will be understood that the inclination of the head portion 406 may be altered to suit the requirements of a particular installation.

The head portion 408 may be provided with holes similar to the holes 108 in the head portion 26 of the showerhead 32 shown in FIGS. 33 and 34. Where provided, the holes in the head portion 408 may perform the same function as the holes 108 and will be understood from the description of FIGS. 33 and 34 and modifications thereof.

Figure 37:
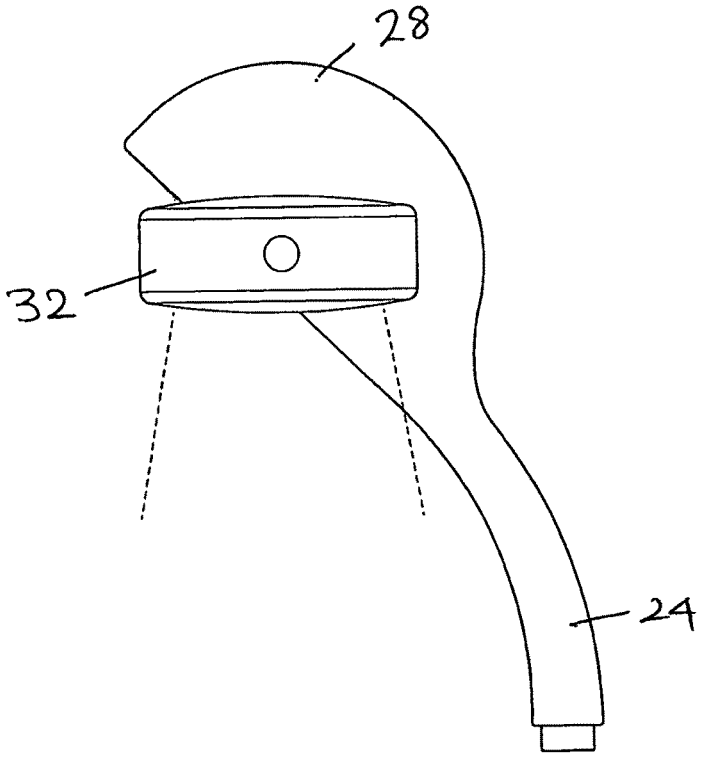
FIG. 37 is a side showing another modification to the showerhead of FIGS. 2 to 16.

In the above-described embodiments, flow of water from the spray head may be uninterrupted during changeover between spray modes due to the overlap between the spray modes provided by the spray selection module, This may result in the spray being directed towards areas outside the normal spray area, particularly behind the spray head. In order to confine the spray during changeover without interruption of the flow, the showerhead may be provided with means for diverting the spray so that it remains within the normal spray area. Such means may be provided by configuring the head portion to prevent the spray escaping to areas outside the normal spray area during the changeover. FIG. 37 shows a modification to the handset of FIGS. 2 to 16 for this purpose where the head portion 28 is modified to enclose parts of the spray head 32 that face rearwardly in any selected spray mode and during changeover between spray modes. In this way, the spray head is prevented from spraying in a rearwards direction, especially during changeover between spray modes. Any other means for diverting the spray so as to confine the spray within a desired area may be employed. A similar feature may be provided in the other embodiments of the showerhead described herein.

In the above-described embodiments, the spray direction is transverse to the pivot axis in each spray mode and this could result in the spray head being subjected to a force tending to rotate the spray head from its set position. This is potentially a problem for manual versions of the showerhead if the force exceeds the frictional force holding the showerhead in its set position. For this reason, the spray outlets of the rotatable spray head are preferably arranged symmetrically with respect to the pivot axis so that flow of water from the spray head in each mode is balanced and forces tending to rotate the spray head from its set position are eliminated or significantly reduced. A symmetrical arrangement of the spray outlets may not be necessary where the frictional force holding the spray head in its set position is large or for powered versions of the showerhead where movement of the spray head is controlled by a motor.

While the invention has been described with what are currently the best modes known to the applicant, it will be understood that we do not intend to be limited thereto. In particular, where appropriate or the context permits, features of the embodiments are interchangeable and features of any of the embodiments may be employed separately or in combination with features of any of the other embodiments.

The invention claimed is:

1. A showerhead comprising:

a support having at least one outlet; and a spray head mounted for rotation relative to the support about a single pivot axis both to select any one of a plurality of spray modes angularly spaced apart in the direction of rotation and to adjust the direction of the spray for the selected spray mode;

wherein the spray head includes at least one diverter port and a hub that is rotatable relative to the at least one diverter port in response to rotation of the spray head, the at least one diverter port being in fluid communication with the at least one outlet, the hub having at least one opening associated with each spray mode; and wherein the at least one opening associated with an adjacent spray mode is configured to overlap the at least one diverter port before the at least one opening associated with the selected spray mode clears the at least one diverter port so that flow of water is uninterrupted during changeover between spray modes.

2. A showerhead according to claim 1 wherein the direction of the spray in a selected spray mode is transverse to the pivot axis.

3. A showerhead according to claim 1 wherein the spray head has two spray modes.

4. A showerhead according to claim 1 wherein, the spray head includes a spray selection module responsive to rotation of the spray head for directing water flow to a spray discharge of the selected spray mode.

5. A showerhead according to claim 1 wherein, spray head includes at least one spray mode with a spray discharge comprising a plurality of holes in a spray plate.

6. A showerhead according to claim 1 wherein the spray head includes at least one spray mode with a spray discharge comprising a single opening.

7. A showerhead according to claim 1 wherein the spray head includes at least one spray mode provided by a detachable spray cartridge.

8. A showerhead according to claim 1 wherein the spray head is rotatable through 360°.

9. A showerhead according to claim 1 wherein the spray head is rotatable by a motor.

10. A showerhead according to claim 1 wherein the spray head is angularly adjustable in each spray mode through an arc including a centre position of the selected spray mode to change the spray direction in the selected spray mode.

11. A showerhead according to claim 10 wherein the spray head is angularly adjustable to either side of the centre position in each spray mode.

12. A showerhead according to claim 11 wherein the angular adjustment to one side of the centre position is larger than the angular adjustment to the other side.

13. A showerhead according to claim 1 including a support for the spray head.

14. A showerhead according to claim 13 wherein the support extends around a marginal edge of the spray head.

15. A showerhead according to claim 13 wherein the support is provided with an outlet separate from the spray head.

16. A showerhead according to claim 15 wherein the outlet comprises a plurality of holes spaced apart in the support, and the support extends around a marginal edge of the spray head.

17. A showerhead according to claim 13 wherein the support is provided by a hollow body through which water is delivered to the spray head.

18. A showerhead according to claim 1 comprising a spray unit for mounting in an opening in a wall, ceiling or similar support surface.

19. A showerhead according to claim 18 wherein the spray unit has a plurality of rotatable spray heads.

20. A showerhead having a spray head mounted for rotation about a single pivot axis both to select any one of a plurality of spray modes angularly spaced apart in the direction of rotation and to adjust the direction of the spray for the selected spray mode, wherein flow of water is uninterrupted during changeover between spray modes;

the showerhead further including a support for the spray head;

wherein the support is provided with an outlet separate from the spray head;

wherein flow of water is provided through the outlet when changing from one spray mode to another spray mode; and wherein the outlet is configured to communicate water to a user independently of the spray head.

21. A showerhead having a spray head mounted for rotation about a single axis wherein the rotation is configured both to select any one of a plurality of spray modes angularly spaced apart in the direction of rotation and to also adjust the direction of the spray for the selected spray mode; and wherein full spray is maintained while rotating the spray head to change the direction of spray for a selected spray mode within a range of angular movement.

22. A showerhead according to claim 21, wherein the range of angular movement providing full spray in one of the plurality of spray modes is between approximately 50 degrees and 80 degrees.

23. A showerhead according to claim 21, wherein the spray head is retained in position by friction.

24. A showerhead according to claim 21, wherein the spray head may be rotated to select any one of at least three spray modes.

* * * * *